US010074349B2

(12) United States Patent
Spivey et al.

(10) Patent No.: US 10,074,349 B2
(45) Date of Patent: Sep. 11, 2018

(54) GUITAR PLECTRUM AND HARNESS COMBINATION

(71) Applicant: Second Pick, LLC, Charleston, SC (US)

(72) Inventors: Michael W. Spivey, Charleston, SC (US); William E. Craver, III, Sullivan's Island, SC (US)

(73) Assignee: SECOND PICK, LLC, Charleston, SC (US)

( * ) Notice: Subject to any disclaimer, the term of this patent is extended or adjusted under 35 U.S.C. 154(b) by 192 days.

(21) Appl. No.: 15/289,564

(22) Filed: Oct. 10, 2016

(65) Prior Publication Data

US 2017/0053627 A1 Feb. 23, 2017

Related U.S. Application Data

(63) Continuation-in-part of application No. 14/072,924, filed on Nov. 6, 2013, now Pat. No. 9,466,271.

(51) Int. Cl.
*G10D 3/16* (2006.01)

(52) U.S. Cl.
CPC ..... *G10D 3/163* (2013.01)

(58) Field of Classification Search
USPC ..... 84/322
See application file for complete search history.

(56) References Cited

U.S. PATENT DOCUMENTS

| | | | | |
|---|---|---|---|---|
| 3,992,975 | A | 11/1976 | Gallagher | |
| 4,102,234 | A | 7/1978 | Brundage | |
| 4,625,616 | A | 12/1986 | McVicker | |
| 5,419,228 | A | 5/1995 | Garrett | |
| 6,054,643 | A | 4/2000 | Chance et al. | |
| 7,157,635 | B2 | 1/2007 | Sogabe | |
| 7,312,386 | B2 | 12/2007 | Siclaff et al. | |
| 7,812,234 | B2 | 10/2010 | Dybas | |
| 8,389,839 | B2 * | 3/2013 | McVicker | G10D 3/163 84/322 |
| 2009/0229442 | A1 | 9/2009 | Hollin, Jr. | |
| 2010/0180748 | A1 | 7/2010 | Fredrick | |
| 2014/0076120 | A1 | 3/2014 | Hollin, Jr. | |
| 2014/0090540 | A1 | 4/2014 | Panagiotes | |

* cited by examiner

*Primary Examiner* — Christopher Uhlir
(74) *Attorney, Agent, or Firm* — J. Bennett Mullinax, LLC

(57) ABSTRACT

A thumb pick is provided that includes a harness and plectrum. The harness is provided for securely holding the plectrum in firm engagement with a guitar player's thumb. The harness includes a strap contoured to fit around the thumb in advance of the first knuckle. The harness has a central portion with a slot therein to receive and hold the plectrum firmly against the undersurface of the thumb with the pointed end of the plectrum protruding through the slot in a playing position.

19 Claims, 13 Drawing Sheets

100

100

100

100

GUITAR PLECTRUM AND HARNESS COMBINATION

RELATED APPLICATIONS

This application is a continuation-in-part patent application which claims the benefit of the filing date of U.S. patent application Ser. No. 14/072,924, filed Nov. 6, 2013, the disclosures of which being incorporated herein by reference in its entirety.

TECHNICAL FIELD

The present disclosure relates to guitar playing equipment and, more particularly, to a novel plectrum and harness combination for attaching said novel plectrum to a player's thumb as employed in playing guitar.

BACKGROUND

Conventional plectrums for playing stringed instruments are commonly a thin piece of flexible plastic, generally triangular in shape that is grasped between the thumb and index finger. The plectrum is moved over the strings of a stringed instrument such as a guitar, bass, ukulele, or the like, to create sound. Such plectrums are generally comprised of the cut or cast plastic materials such as nylon, polycarbonate, high-density polyethylene, or other flexible polymers. Plectrums are typically the cut from a sheet or injection molded. Grasping a plectrum between the thumb and forefinger can cause fatigue that can lead to dropping the plectrum during performance. Such grasping can also reduce the flexibility of the plectrum. Means of attaching a plectrum to the thumb have been developed to mitigate such drawbacks and are referred to as thumb picks.

Accordingly, it is an object of the disclosed embodiment to provide a comfortable means of engaging a replaceable plectrum with a thumb, further providing a tactile engagement between said harness and plectrum, further providing engagement with the thumb allowing for appropriate flex of the plectrum.

SUMMARY

In accordance with embodiments of the present disclosure, an example embodiment 100 is illustrated in FIGS. 1 through 6. Referring to FIG. 1 and FIG. 2, a flexible body 130 is comprised of a resilient material and although may be made of leather or textile materials, the preferred embodiment is comprised of a castable elastomer that may be any of a number of polyurethanes, silicones or vinyls. Appropriate castable elastomer shore-durometer measurements for some embodiments are between Shore-00 rating between 30 and 80 and Shore-A rating between 0 and 40.

In accordance with embodiments of the present disclosure, an example harness and plectrum combination is provided that includes a semi-rigid molded harness that provides specific tactile means of engagement with the root of the thumb nail, the thumb tip and the thumb pad. The semi-rigid molded harness is affixed to the thumb with a strap that is received by a channel with molded engagement means to hold the strap. A slot in the harness is provided that receives a replaceable plectrum. A replaceable plectrum comprises a substantially curved surface that engages with both the harness and with the surface of the thumb for tactile engagement with the plectrum. A groove and flare engage the plectrum with the slot in the harness.

These and other non-limiting features or characteristics of the present disclosure are further described below. Features are provided from the following description are achieved in accordance with the present invention by providing a harness consisting of a castable elastomer form contoured to fit the thumb with tactile engagement with the root of the thumb nail, the tip of the thumb and the thumb pad and which has a portion dimensioned to provide an area that receives and hold a contoured pick such a plectrum providing a surface that sits firmly against the surface of the thumb with the substantially pointed end of the plectrum protruding through said slit into playing position.

Any combination or permutation of embodiments is envisioned. Additional advantageous features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

The following is a brief description of the drawings, which are presented for the purposes of illustrating the disclosure set forth herein and not for the purposes of limiting the same. Example embodiments of the present disclosure are further described with reference to the appended figures. It is to be noted that the various features and combinations of features described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DETAILED DESCRIPTION

Figure 1:
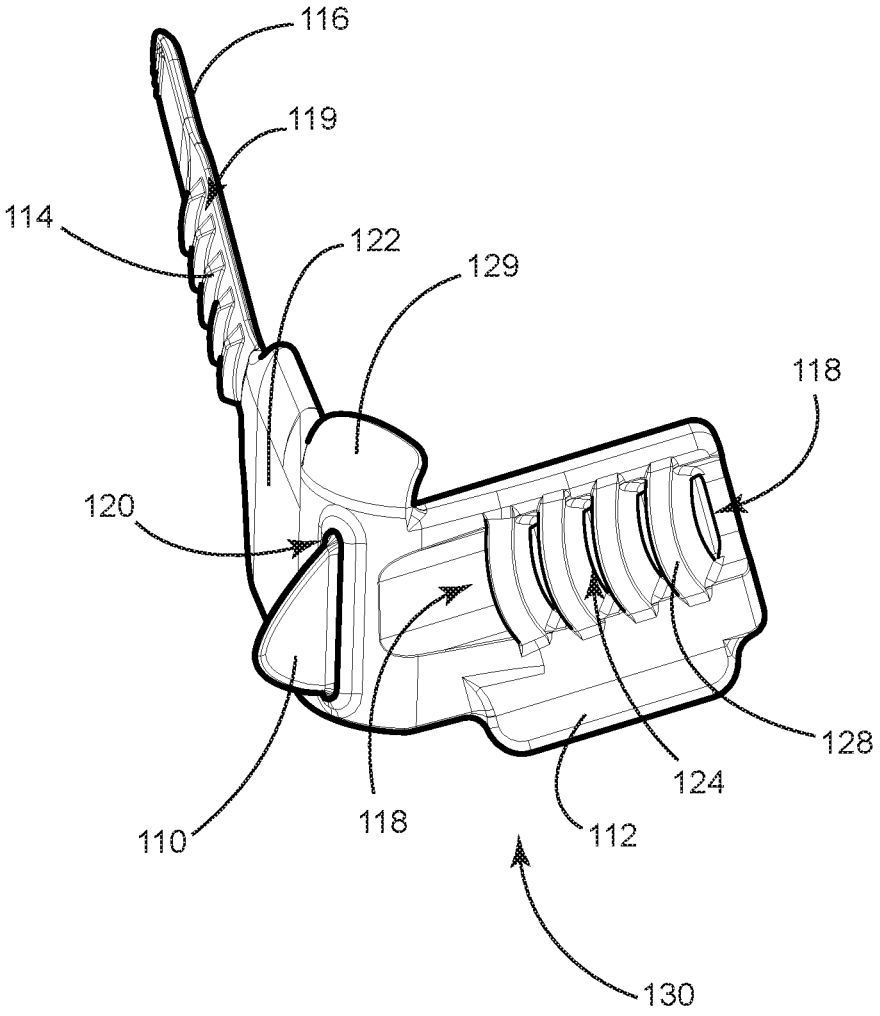
FIG. 1 is a front, left perspective view of an example thumb pick according to the present disclosure.

The example embodiments disclosed herein are illustrative of advantageous features and functions for an improved harness and plectrum combination providing comfort and tactile engagement with both the harness and plectrum. A more complete understanding of the components, processes, and apparatuses disclosed herein can be obtained by reference to the accompanying figures. These figures are intended to demonstrate the present disclosure and are not intended to show relative sizes and dimensions or to limit the scope of the disclosed embodiments. In particular, the figures provided herein are not necessarily to scale and, in certain views, parts may be exaggerated for purposes of clarity.

Although specific terms are used in the following description, these terms are intended to refer only to particular structures in the drawings and are not intended to limit the scope of the present disclosure. It is to be understood that like numeric designations refer to components of like function.

The terms "about" or "approximately" when used with a quantity include the stated value and also have the meaning dictated by the context. For example, they include at least the degree of error associated with the measurement of the particular quantity. When used in the context of a range, the terms "about" or "approximately" should also be considered as disclosing the range defined by the absolute values of the two endpoints. For example, the range "from about 2 to about 4" or "from approximately 2 to approximately 4" also discloses the range "from 2 to 4".

Example embodiments include, but are not limited to, a molded elastomeric harness having tactile engagement with the root of the thumb nail, the tip of the thumb and the pad of the thumb. The molded harness further provides a slot for engagement with a replaceable plectrum. The replaceable plectrum includes a portion for interacting with the strings of a stringed instrument and a surface that is in contact with the surface of the thumb, thus providing the user with the feel of the contact of the plectrum with the strings.

Figure 2:
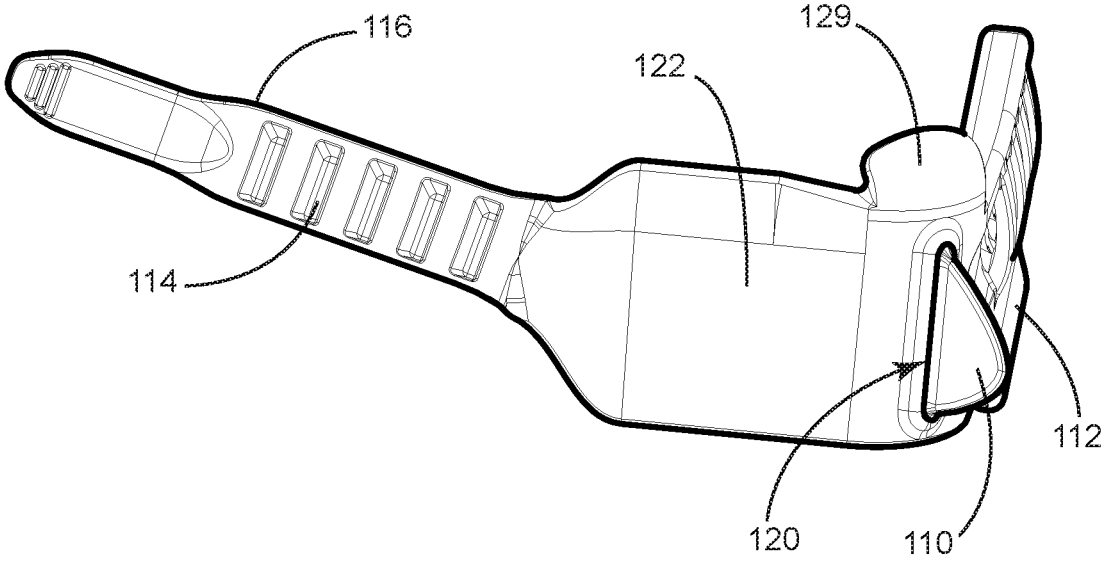
FIG. 2 is a front, right perspective view of an example thumb pick according to the present disclosure.

Turning now to FIG. 1, and FIG. 2 front, left and front right perspective views respectively of an example embodiment of a thumb pick 100 of a harness and plectrum combination is shown. The harness 130, comprised of a castable elastomer as previously described. The harness comprises a strap 116 having a plurality of protrusions 114 and spaces between protrusions 118. The strap is enjoined with a mid-section 122 that has a slot 120 for a plectrum 110. A curve in the surface provides a stop 129 that rests on the tip of the thumb preventing the harness from sliding along the long axis of the thumb. A slot 118 receives the strap 116. Spaces 124 and ridges 128 engage with protrusions 114 and the spaces between protrusions 119 respectively.

Figure 3:
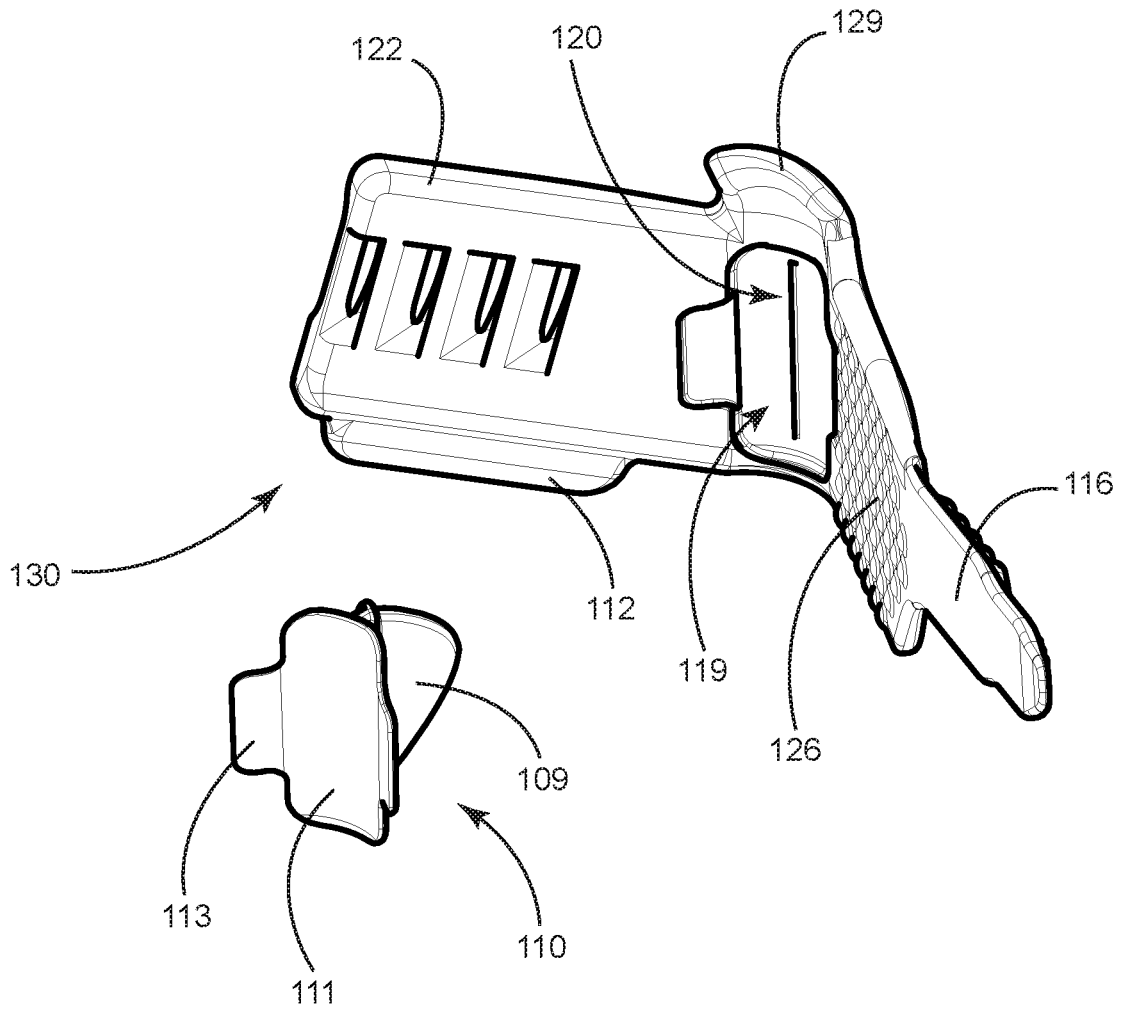
FIG. 3 is a rear perspective, exploded view of an example thumb pick according to the present disclosure.
Figure 4:
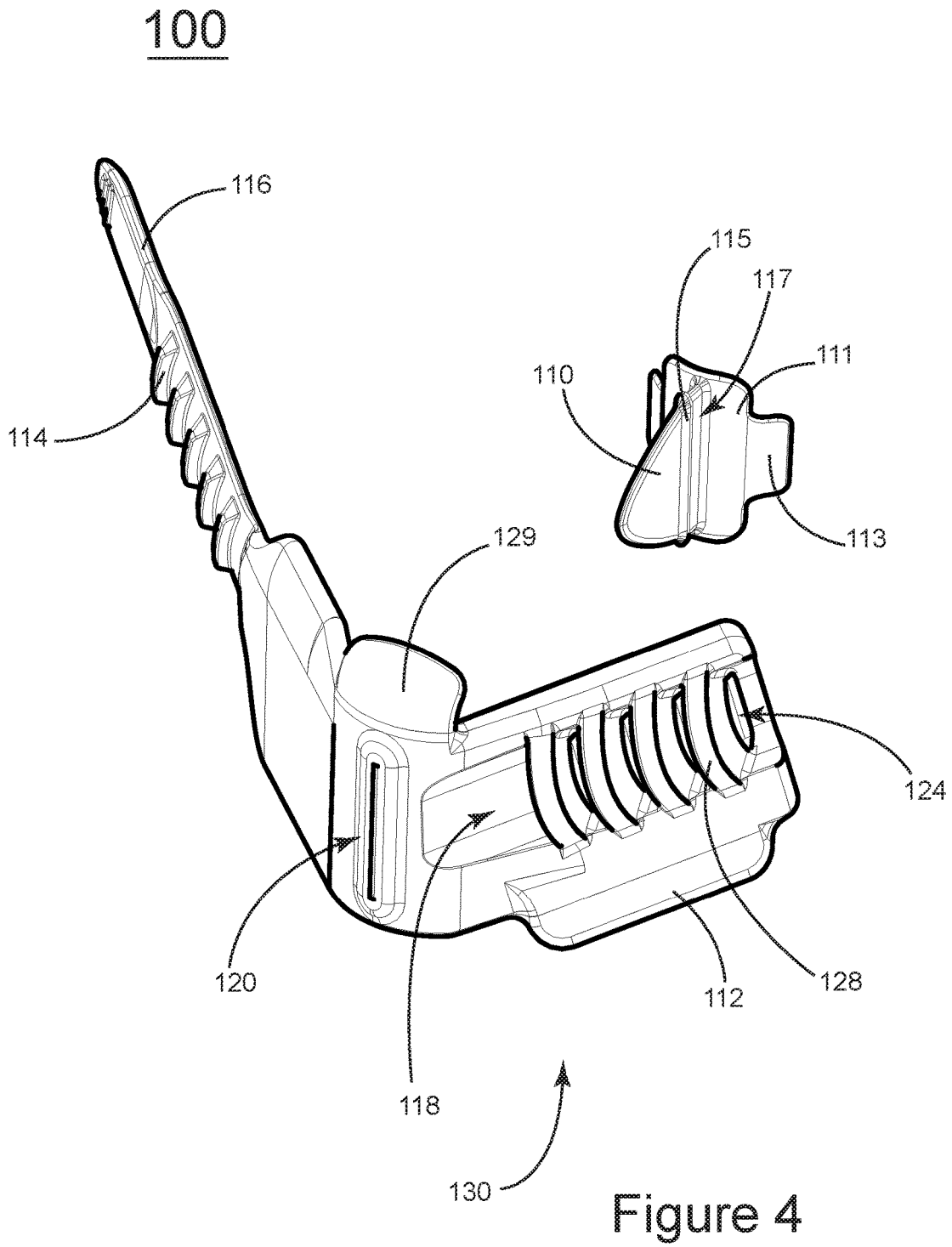
FIG. 4 is a front perspective, exploded view of an example thumb pick according to the present disclosure.

Referring to FIG. 3 and FIG. 4, rear and front exploded, perspective views are shown. The plectrum 110 is removed from the slot 120. Seen in this view is a textured surface 126 on the inferior of the harness 130. The textured surface 126 provides proper engagement between the harness 130 and the thumb.

The plectrum 110 comprises a substantially pointed portion 109 for engaging with the strings of a stringed instrument. The plectrum further comprises a rear surface 111 and tabs 113 that engage with a recess 119 in the harness 130 and also engages with the surface of the thumb. Proper engagement with the surface of the thumb provides a means of transferring the vibration that occurs as the playing portion 109 of the plectrum 110 makes contact with a string(s) of a stringed instrument. In this manner, the harness 130 does not interfere with the tactile sensation on the thumb of the plectrum 110 on the strings. The plectrum 110 engages with the harness 130 being fitted through the slot 120. The plectrum 110 can also comprise a recess 117 that is of a similar dimension to the width of the slot 120 and a flared portion 115 that is wider than the slot 120. As the harness 130 is comprised of an elastomeric material, the slot 120 is able to flex sufficiently to receive the flared portion 115. Once through the slot the flared portion 115 rests on the outer surface of the harness 130 thus keeping the plectrum in place.

Figure 5:
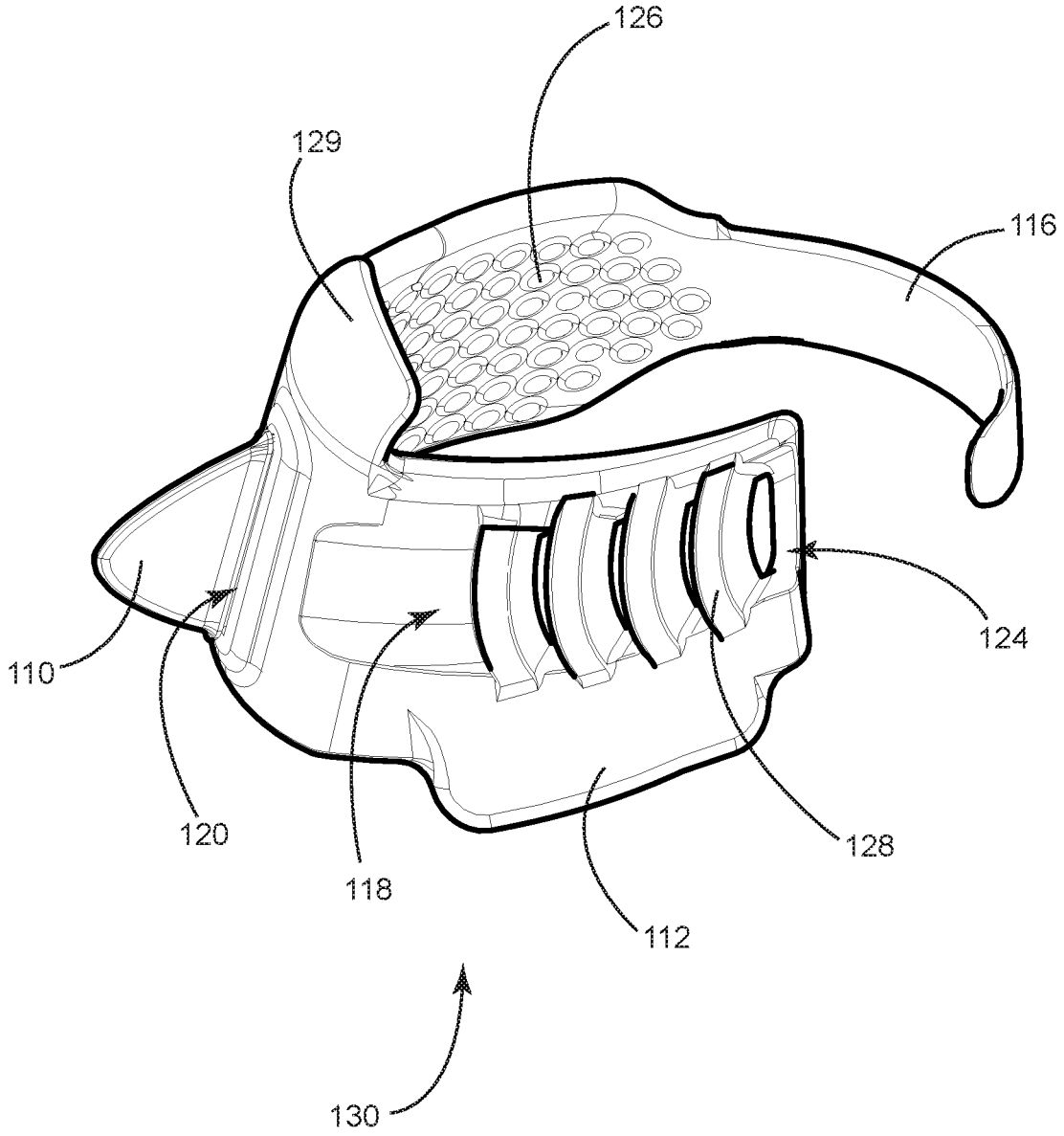
FIG. 5 is a front, left perspective view of a thumb pick according to the present disclosure in a semi-closed position.
Figure 6:
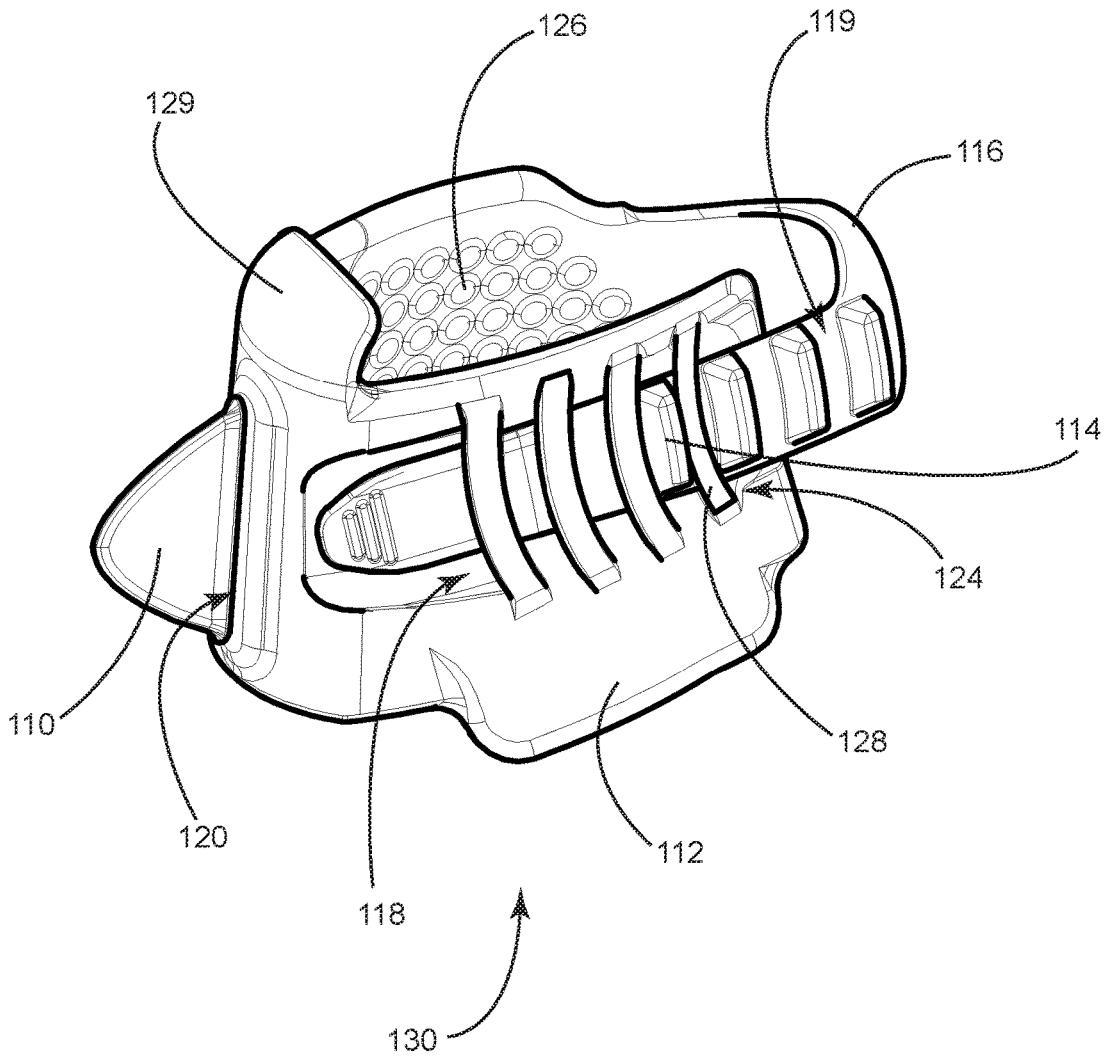
FIG. 6 is a front, left perspective view of a thumb pick according to the present disclosure in a closed position.
Figure 7:
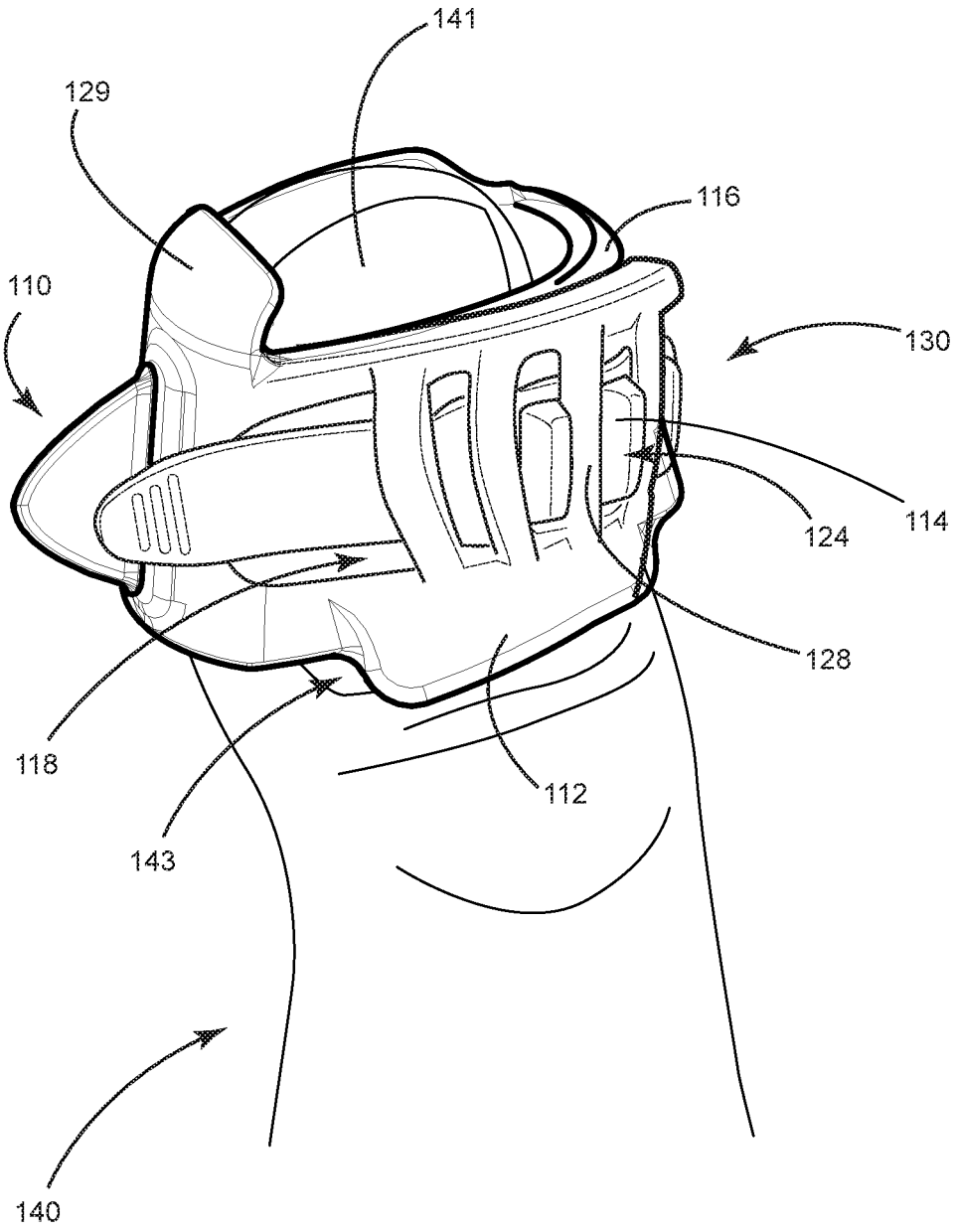
FIG. 7 is a front, left perspective view of a thumb pick according to the present disclosure in a closed position over a thumb.
Figure 8:
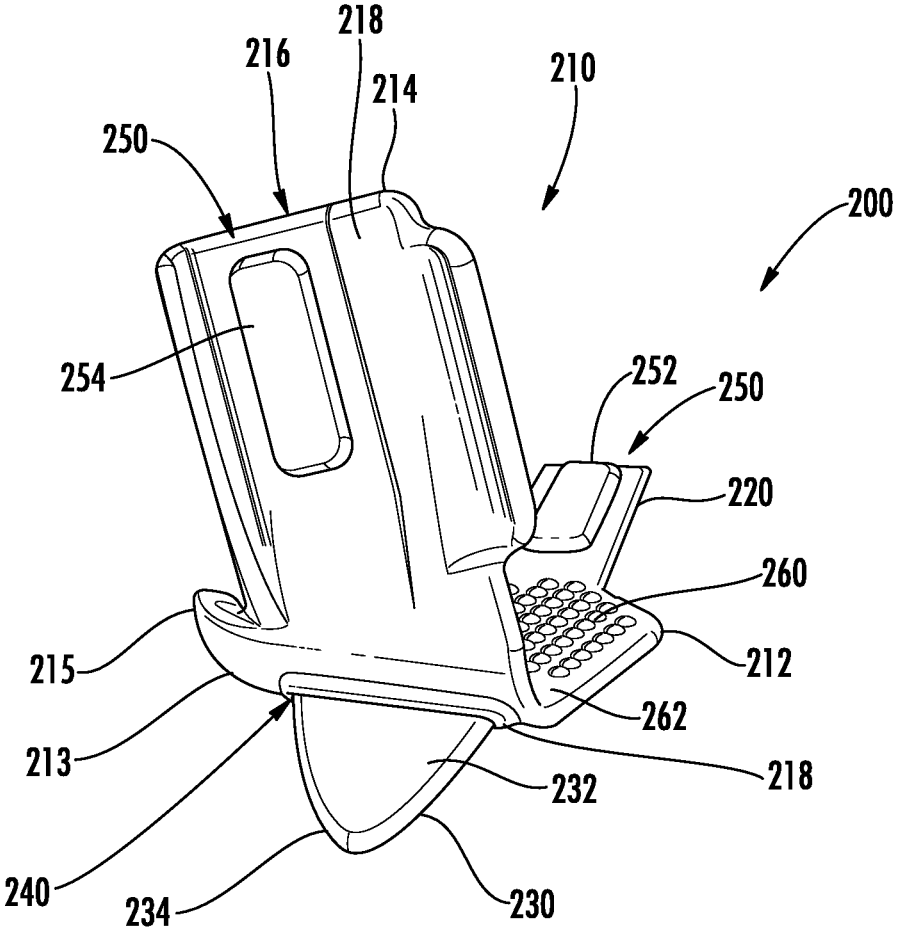
FIG. 8 is a front, right perspective view of an embodiment of a thumb pick according to the present disclosure.
Figure 9:
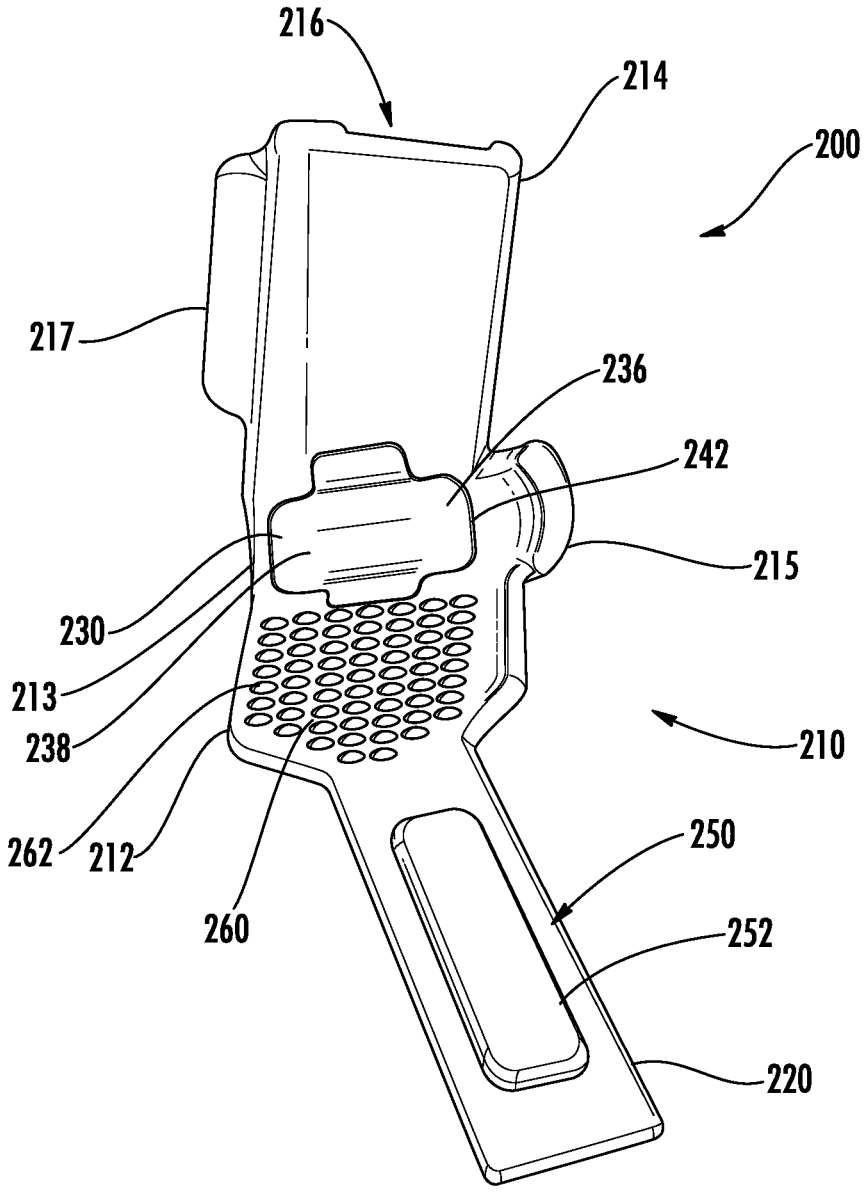
FIG. 9 is a rear perspective view of the embodiment of the thumb pick according to FIG. 8.
Figure 10:
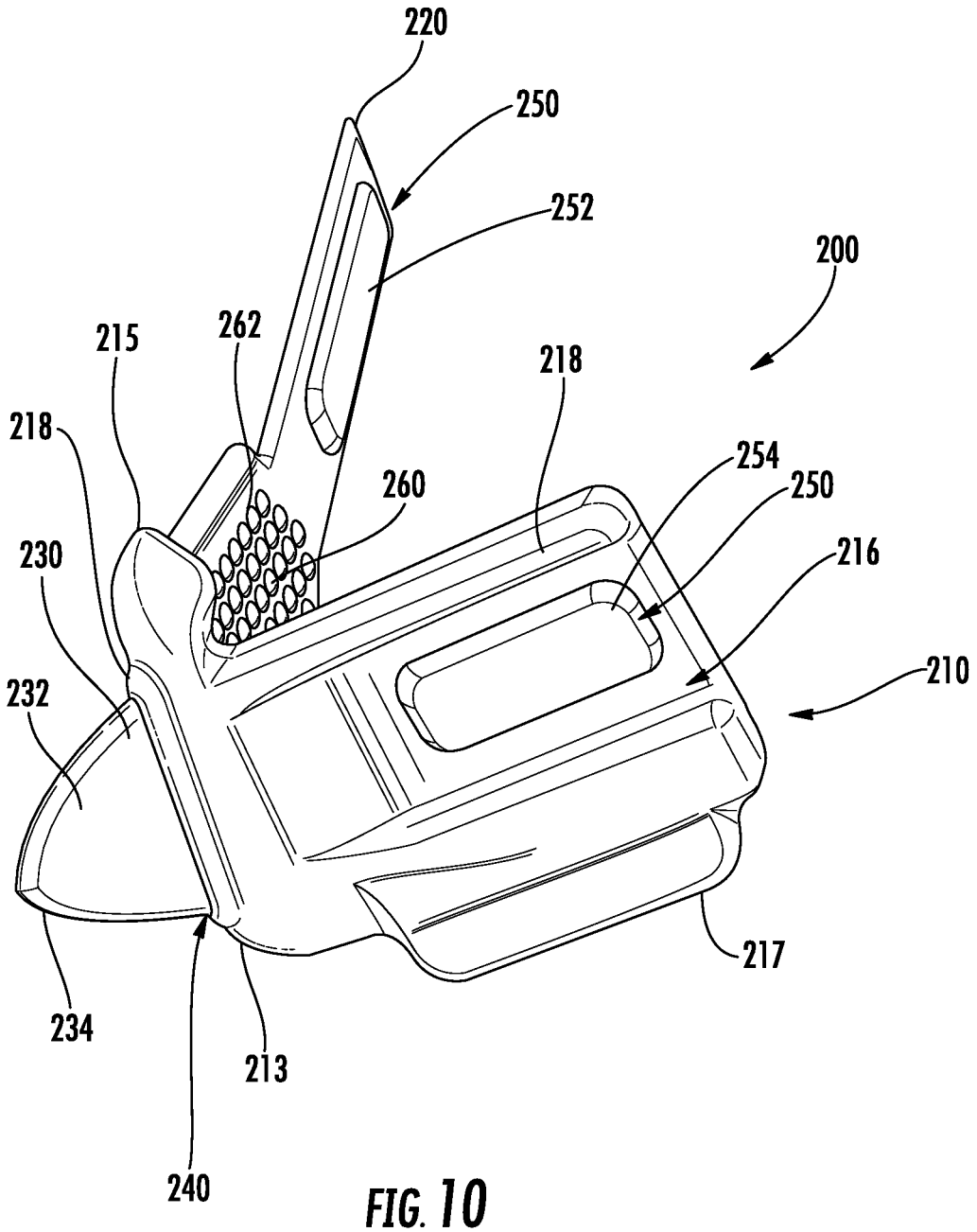
FIG. 10 is a front, left perspective view of the embodiment of the thumb pick according to FIG. 8.
Figure 11:
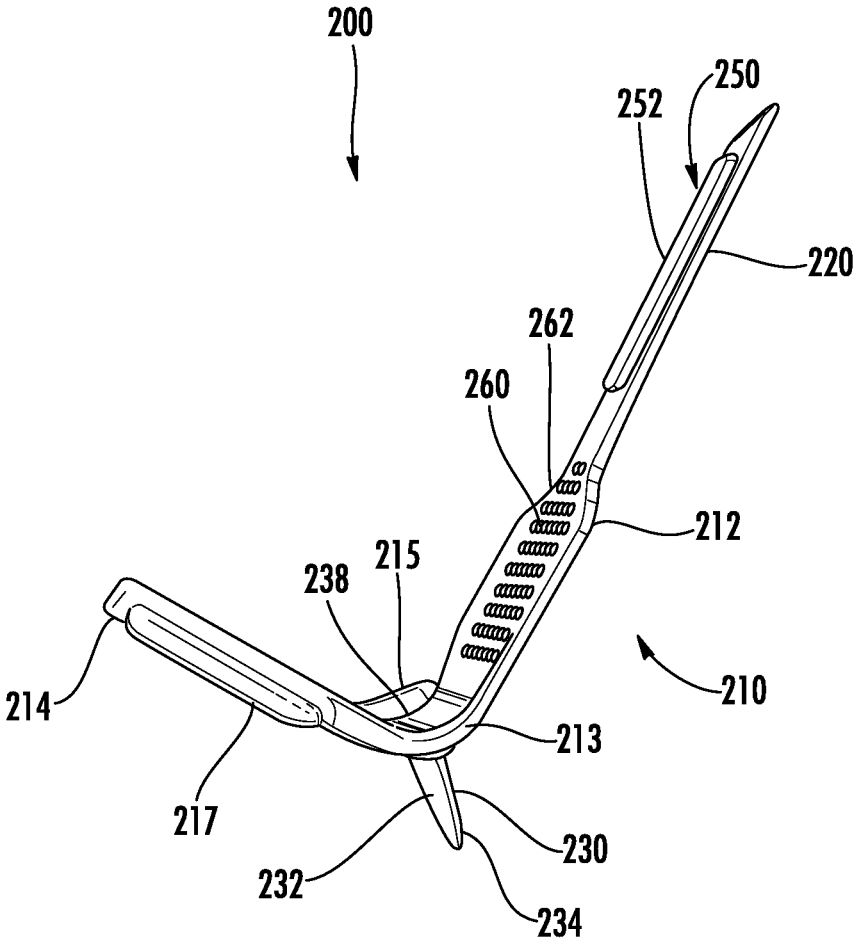
FIG. 11 is a side perspective view of the embodiment of the thumb pick according to FIG. 8.

Referring to FIG. 5, FIG. 8 and FIG. 7 front perspective views of the harness 130 and plectrum 110 combination is illustrated with the harness 130 flexed. FIG. 7 illustrates the harness 130 flexed and worn on a thumb 140. The strap 116 is received by the slot 118 and protrusions 114 secure the strap in place by residing between the ridges 128. In other words, a plurality of protrusions 114 and spaces 119 between protrusions 114 engage respectively with spaces between ridges 124 and ridges 128 to provide adjustability in the diameter of the harness 130 to fit various size thumbs 140. The textured portion 126 of the harness 130 resides against the pad of the thumb. The stop 129 can be seen in FIG. 7, resting against the tip of the thumb 141. A curved surface 112 rests against the root of the thumb nail 143 providing a tactile location of the harness with the thumb nail root 143.

Referring to FIGS. 8-13, another embodiment of a thumb pick, generally designated 200, for engaging with strings of a stringed instrument is provide. As with the thumb pick 100 described above in FIGS. 1-7, the thumb pick 200 shown in FIGS. 8-13 can comprise a flexible harness 210 having a first side 212 and a second side 214 and a strap 220 extending from the first side 212 of the harness 210. The thumb pick 200 can also comprise a groove 216 in an outer surface 218 of the second side 214 of the harness 212 for receiving the strap 220. The harness 210 can also comprise a middle section 213 between the first side 212 and the second side 214 of the harness. The middle section 213 can include a stop 215 at an outer end of the middle section 213. In particular, the stop 215 can be a protrusion that can be formed by the outer end of the middle section 213 being curved upward. In use, the tip of the users thumb can rest against the stop 215, similar to the stop 128 shown in FIG. 7, to prevent the harness 210 from sliding along the users thumb.

The thumb pick 200 can further comprise a plectrum 230 with a substantially planar portion 232 that comprises a playing portion 234 of the plectrum 230 for contacting strings of a stringed instrument. The plectrum 230 can also comprise a substantially curved portion 236 that has a rear surface 238 at an end 232A of the planar portion 232. The curved portion 236 and the rear surface 238 can extend outward above opposing sides of the planar portion 232 of the plectrum 230 so that the substantially curved portion 236 is transverse to the substantially planar portion 232. For example, the substantially curved portion 236 can be about perpendicular to the substantially planar portion 232.

The harness 210 can further comprise a vertical slot 240 for receiving the plectrum 230. The harness can also comprise a recess 242 proximal to the slot 240. For example, the slot 240 and the recess 242 can reside in the middle section 213 of the harness 210. The slot 240 can engage the substantially planar portion 232 of the plectrum 230 and the recess 242 can engage the substantially curved portion 236 of the plectrum 230, such that at least a portion of the substantially curved portion 236 of the plectrum 230 resides in the recess 242.

Figure 12:
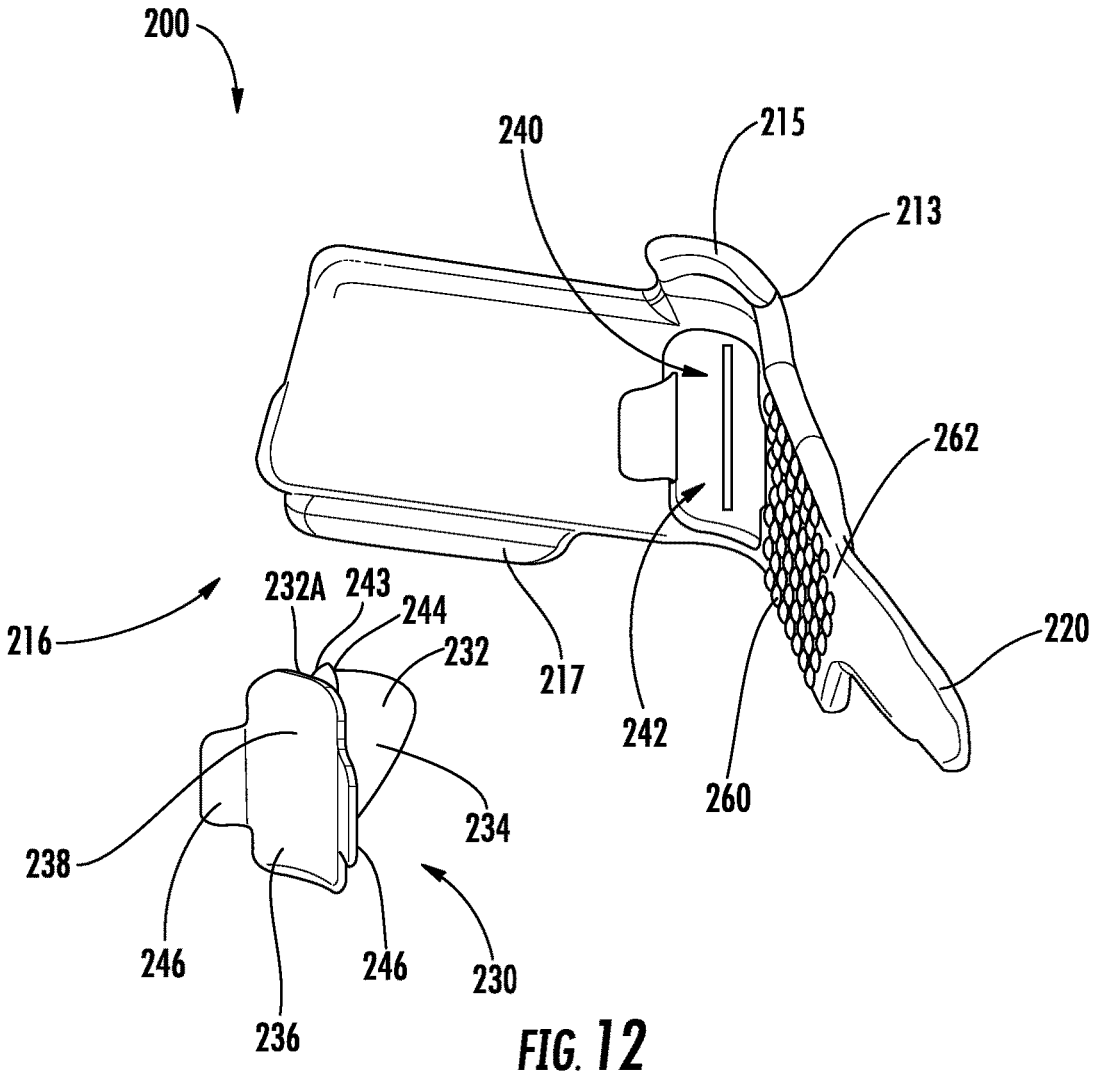
FIG. 12 is a rear perspective, exploded view of the embodiment of the thumb pick according to FIG. 8.
Figure 13:
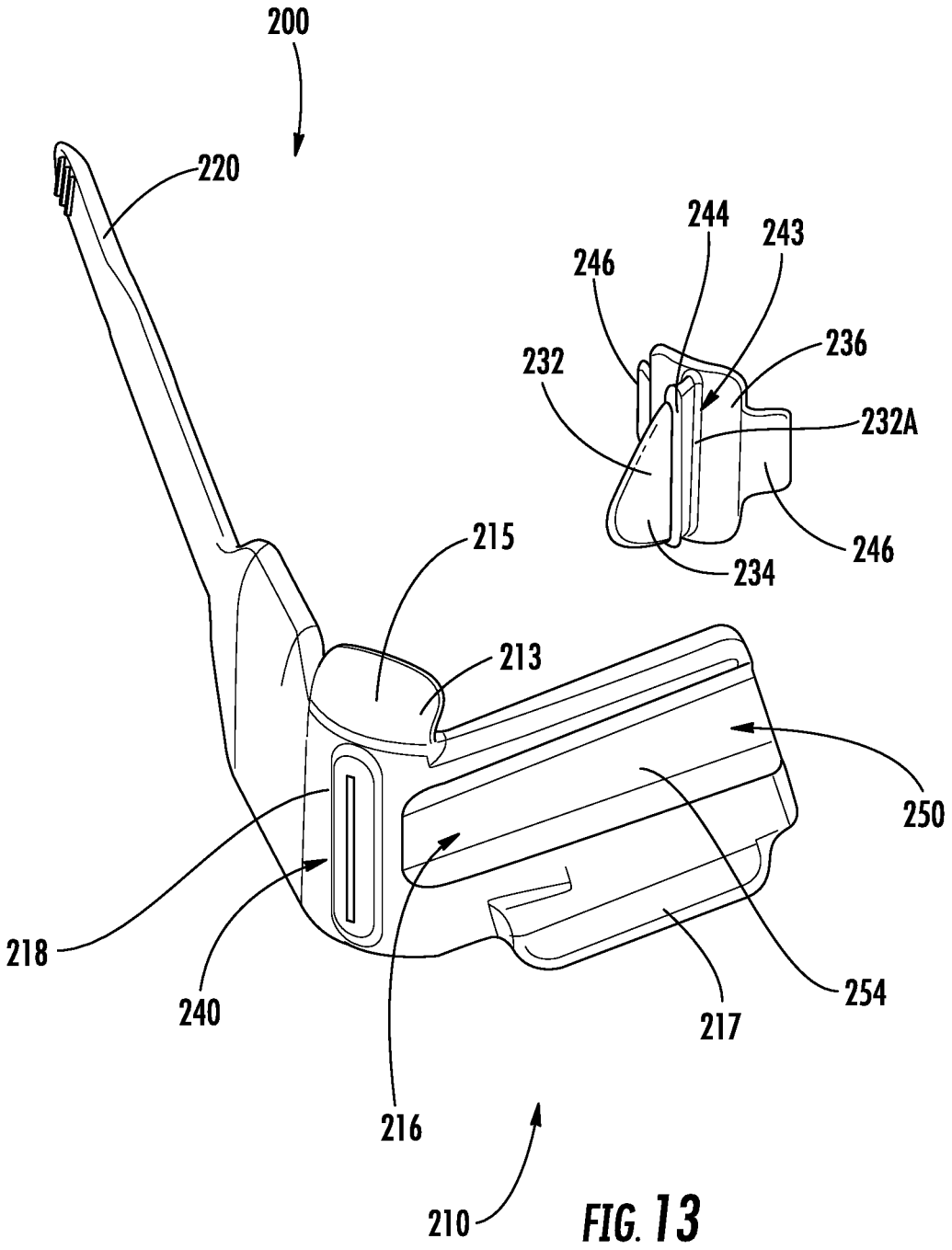
FIG. 13 is a front perspective, exploded view of the embodiment of the thumb pick according to FIG. 8.

In some embodiments, the plectrum 230 can comprise a recess portion 243 and a flared portion 244 as shown in FIGS. 12 and 13. In some embodiments, the flared portion 244 can reside on the substantially planar portion 232 proximal to the end 232A with the recess portion 243 above the flared portion 244 on the substantially planar portion between the flared portion 244 and the curved portion 236 of the plectrum 230. In such embodiments, the flared portion 244 is wider than the slot 240 that flexibly receives the flared portion 244, so that, once through the slot 240, the flared portion 244 rests on the outer surface 218 of the harness 210 to keep the plectrum 230 in place, while the recess portion 243 rests within the slot 240. Thereby, the recess portion 243 serves as an inset for receiving the edges of the middle section 213 of the harness 210 that form the slot 240. Additionally, the curved portion 238 of the plectrum 230 can comprise tabs 246 mat extend outward from the curved portion 236 on either side of the planar portion 232 of the plectrum 230 and fit within the recess 242 in the interior surface of the harness 210 when the planar portion 232 is inserted through the slot 240 in the harness 210. By having the tabs 246 of the curved portion 236 of the plectrum 230 residing in the recess 242 of the harness 210, the plectrum 230 can have added stability when the thumb of the user resides against the curved portion 238 when the strap 220 is secured within the groove 216 on the second side 214 of the harness 210 snugly around the thumb.

Like the embodiments shown in FIGS. 1-7 and described above, the thumb pick 200 can comprise a fastener device 250 for securing the strap 220 within the groove 216 of the harness 210 as shown in FIGS. 8-13. For example, the fastener device 250 can comprise a first portion 252 that can be secured to the strap 220 and a second portion 254 that can be secured within the groove 216 of the harness 210. The first portion 252 can be configured to matingly engage the second portion 254 to hold the strap 220 within the groove 216. As shown in FIGS. 8-13 in some embodiments, the fastener device 250 can comprise a hook and loop fastener, such as those fasteners sold under the brand name Velcro™. In some embodiments, the first portion 252 of the fastener device 250 can comprise a hook section and the second portion 254 of the fastener device 250 can comprise a loop section. In some embodiments, the first portion 252 of the fastener device 250 can comprise a loop section and the second portion 254 of the fastener device 250 can comprise a hook section.

The hook and loop fastener 250 can increase the ease of affixing the pick 200 to the thumb. The user can simply wrap the strap 220 around the thumb as snugly as needed or desire and place the strap 220 in the groove 216 to attach the two sides 252, 254 of hook and loop fastener 250 together. The fastener device 250 can firmly hold the strap 220 in the groove 216 of the harness 210 and not have a tendency to work loose during the playing of a stringed instrument with the thumb pick 200. In addition, the fastener device 250 will stay locked at the same size at which it was attached which allows the end user to slide the pick 200 off and on at will without having to readjust it for every use. The pliable nature of the harness material can have a high coefficient of friction with skin and permit this slide on and slide off feature. Thereby, the hook and loop fastener 250 can permit a faster fit and can be much easier to attach and adjust. Additionally, the hook and loop fastener 250 can provides a tighter fit that can provide improved stability during play while also providing improved comfort. Further, the hook and loop fastener 250 can provide easier reuse through the ability to slide the pick 200 on and off after being fit, while also providing a greater size range.

In some embodiments, other fastener devices can be used. For instance, the fastener device can be one or more snap fasteners. For example, the fastener device that can comprise first and second portions that can be male and female connector portions of one or more snap fasteners that can matingly engage to fasten the strap in the groove of the harness. For example, the first portion can be a male connector secured to a strap and the second portion can be one or more female connectors within the groove of the harness for receiving the male connector of the first portion on the strap. If two or more female connectors are secured in a row in the groove, then the male connector can be secured in different female connectors to more securely fit the size of the user's thumb to allow the strap/harness connection to be adjustable. Similarly, if two or more snap fasteners are present the harness can also be adjustable.

As with the embodiments described above, the harness 210 can comprise a tactile texture 260 in an interior surface 262 of the harness 210 for engaging with a pad of a thumb of a user on which the thumb pick 200 is placed. The tactile texture 260 in the interior surface 262 of the harness 210 can be shaped protrusions. For example, the tactile texture 260 in the interior surface 262 of the harness 210 can be disc shaped protrusions as shown in FIGS. 3, 5, 6, and 8-12. The tactile texture 260 in an interior surface 262 of the harness 210 can be a variety of different shaped protrusions as long as the protrusions aid in creating a fractional engagement to hold the pick 200 on the thumb once the strap 220 is secured to the groove 216 in the harness 210 snugly around the thumb.

The harness 210 of the thumb pick 200 can also comprise a protrusion, or stop 215 for engaging with a tip of the thumb of the user and a curved portion 217 for engaging with a root of the thumb nail similar to the protrusion 129 and curved portion 112 of the thumb pick 100 shown in FIG. 7. For example, the curved portion 217 can engage with a surface of the thumb of the user. As with the early described embodiments, in some embodiments, the harness 210 can be formed of rubber or rubber-like material having a shore-A rating between 0 and 40. In some embodiments, the harness 210 can be formed of rubber or rubber-like material having a shore-00 rating between 30 and 80.

Although the systems and methods of the present disclosure have been described with reference to example embodiments thereof, the present disclosure is not limited to such example embodiments and or implementations. Rather, the systems and methods of the present disclosure are susceptible to many implementations and applications, as will be readily apparent to persons skilled in the art from the disclosure hereof. The present disclosure expressly encompasses such modifications, enhancements and or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A thumb pick for engaging with strings of a stringed instrument, the thumb pick comprising:

a flexible harness having a first side and a second side;

a strap extending from the first side of the harness; and a groove in an outer surface of the second side of the harness for receiving the strap;

a plectrum with a substantially planar portion that comprises a playing portion of the plectrum for contacting strings of a stringed instrument and a substantially curved portion that has a rear surface at an end of the planar portion wherein the curved portion and the rear surface extends outward above opposing sides of the planar portion of the plectrum so that said substantially curved portion is transverse to said substantially planar portion; and the harness further comprising a vertical slot for receiving said plectrum; and a recess, wherein the harness engages at least a thumb nail of a user, proximal to the slot wherein the slot engages the substantially planar portion of the plectrum and the recess engages the substantially curved portion of the plectrum, such that at least a portion of the substantially curved portion of the plectrum resides in the recess.

2. The thumb pick according to claim 1 further comprise a fastener device for securing the strap within the groove of the harness.

3. The thumb pick according to claim 2 wherein the fastener device comprises a first portion secured to the strap and a second portion secured within the groove of the harness, the first portion being configured to matingly engage the second portion to hold the strap within the groove.

4. The thumb pick according to claim 2 wherein the fastener device comprises a hook and loop fastener.

5. The thumb pick according to claim 3 wherein the first portion of the fastener device comprises a hook section and the second portion of the fastener device comprises a loop section.

6. The thumb pick according to claim 3 wherein the first portion of the fastener device comprises a loop section and the second portion of the fastener device comprises a hook section.

7. The thumb pick according to claim 1 wherein the harness further comprises a tactile texture in an interior surface of the harness for engaging with a pad of a thumb of a user on which the thumb pick is placed.

8. The thumb pick according to claim 1 wherein the harness further comprises:

a protrusion for engaging with a tip of a thumb; and a curved portion for engaging with a root of the thumb nail.

9. The thumb pick according to claim 8 wherein the curved portion engages with a surface of the thumb of the user.

10. The thumb pick according to claim 1 wherein the harness is formed of rubber or rubber-like material having a shore-A rating between 0 and 40.

11. The thumb pick according to claim 1 wherein the harness is formed of rubber or rubber-like material having a shore-00 rating between 30 and 80.

12. The thumb pick according to claim 1 wherein the substantially planar portion of the plectrum comprises a flared portion that is wider than the slot that flexibly receives the flared portion, so that, once through the slot, the flared portion rests on the outer surface of the harness to keep the plectrum in place.

13. The thumb pick according to claim 1 wherein the curved portion of the plectrum comprises tabs that extend outward from the curved portion on either side of the planar portion of the plectrum, the tabs fitting within the recess in the interior surface of the harness when the planar portion is inserted through the slot in the harness.

14. A thumb pick for engaging with strings of a stringed instrument, the thumb pick comprising:

a flexible harness having a first side and a second side;

a strap extending from the first side of the harness;

a groove in an outer surface of the second side of the harness for receiving the strap;

a fastener device, the fastener device comprising a first matching fastener portion on the strap and a second matching fastener portion proximal to the groove in the second side of the harness, the first matching fastener portion configured to be securable to the second matching fastener portion;

a plectrum with a substantially planar portion that comprises a playing portion of the plectrum for contacting strings of a stringed instrument and a substantially curved portion that has a rear surface at an end of the planar portion wherein the curved portion and the rear surface extends outward above opposing sides of the planar portion of the plectrum so that said substantially curved portion is transverse to said substantially planar portion; and the harness further comprising a vertical slot for receiving said plectrum; and a recess, proximal to the slot wherein the slot engages the substantially planar portion of the plectrum and the recess engages the substantially curved portion of the plectrum, such that at least a portion of the substantially curved portion of the plectrum resides in the recess; wherein the harness engages at least a thumb nail of a user.

15. The thumb pick according to claim 14 wherein the first matching portion is on an interior surface of the strap and the second matching portion resides within the groove in the outer surface of the second side of the harness.

16. The thumb pick according to claim 14 wherein the fastener device comprises a hook and loop fastener.

17. The thumb pick according to claim 16 wherein the first portion of the fastener device comprises a hook section and the second portion of the fastener device comprises a loop section.

18. The thumb pick according to claim 16 wherein the first portion of the fastener device comprises a loop section and the second portion of the fastener device comprises a hook section.

19. The thumb pick according to claim 14 wherein the harness further comprises:

a tactile texture in an interior surface of the harness for engaging with a pad of a thumb of a user on which the thumb pick is placed;

a protrusion for engaging with a tip of the thumb; and a curved portion for engaging with a root of the thumb nail.

* * * * *